United States Patent [19]

Kondo et al.

[11] 3,999,952

[45] Dec. 28, 1976

[54] SINTERED HARD ALLOY OF MULTIPLE BORIDE CONTAINING IRON

[75] Inventors: Yoshikazu Kondo; Takeshi Okada; Yoichi Minoura; Michio Watanabe, all of Yokohama, Japan

[73] Assignee: Toyo Kohan Co., Ltd., Tokyo, Japan

[22] Filed: Feb. 28, 1975

[21] Appl. No.: 554,326

[52] U.S. Cl. ..... 29/182.5; 75/202

[51] Int. Cl.[2] ..... C22C 33/02; B22F 3/12

[58] Field of Search ..... 75/202; 24/182.5

[56] References Cited

OTHER PUBLICATIONS

Steinitz, R. et al. "New Ternary Boride Compounds," in Powder Met. Bull. 6(4): pp. 123–125, 1953.

Haschke, H. et al. "Untersuchungen in Jen Driestopfen: {Mo, W}–{Fe, Co, N,}–B", in Monta. Fur Chemie. 97(5):1459–1468, 1966.

Rieger, W. et al. "Uber einige Kompleboride von Ubergangsmetallen", in Monta. Fur Chemie. 96(3): pp. 844–851, 1965.

Binder, I. et al. "An Evaluation of Molybdenum Boride as Cutting Tools," in Powder Met. Bull. 6(5) pp. 154–162, 1953.

Schwarzkupp, P. et al. Cemented Carbides, MacMillan, N.Y. 1960, pp. 32–51.

*Primary Examiner*—Richard E. Schafer

*Attorney, Agent, or Firm*—Wenderoth, Lind & Ponack

[57] ABSTRACT

This invention relates to a sintered alloy of a boride containing iron consisting essentially of a hard phase composed mainly of iron boride or a multiple boride containing iron in which a part of iron boride is substituted by a non-ferrous boride or multiple boride and a metal phase composed of at least one metal selected from Cu, Co, Ni, Fe, Cr, Mo, W, Ti, Zr, Hf, V, Nb, Ta and alloys composed mainly of these metals, wherein the boron content is 3 to 20% by weight, and to a method of making such sintered alloy. The sintered alloy of this invention has a hardness higher than that of high speed steel and has such high hardness and strength that it is comparable to alloys of cemented carbide, and it is characterized in that it has a good corrosion resistance at room temperature, a high oxidation resistance at high temperatures, a high hardness and a high strength, and that it is cheaper and lighter than cemented carbide. This invention provides a novel sintered high-hardness material which will take the place of cemented carbide or high speed steel.

4 Claims, 1 Drawing Figure

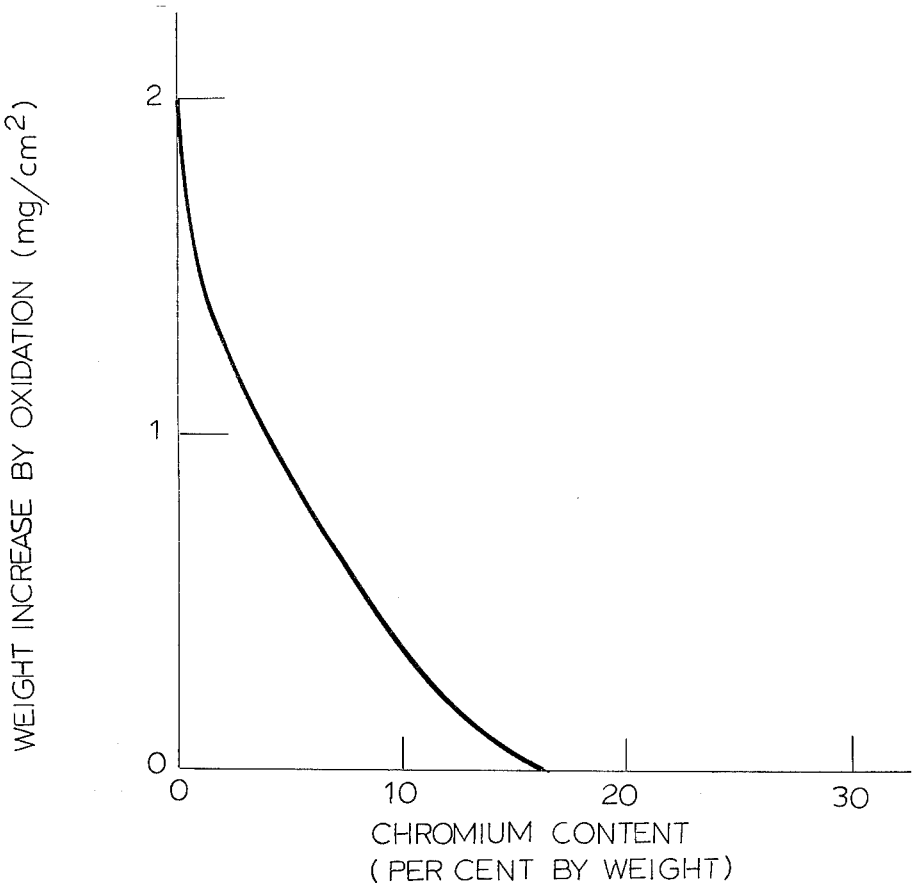
WEIGHT INCREASE BY OXIDATION (mg/cm²)
2
1
0
0
10
20
30
CHROMIUM CONTENT
(PER CENT BY WEIGHT)

SINTERED HARD ALLOY OF MULTIPLE BORIDE CONTAINING IRON

BACKGROUND OF THE INVENTION

High speed steels have heretofore been frequently used for production of metal-cutting tools, metal molds, metal processing dies, and the like. As hard alloy materials having a hardness higher than high speed steels, there have been broadly been used cemented carbide alloys, especially materials composed of tungsten carbide or a double carbide of tungsten with titanium, tantalum, niobium, etc., and cobalt as a binding material.

Since such cemented carbide comprises tungsten as the main element, its specific gravity is as high as 13 to 15, and further, the cost of the raw material is high. Moreover, tungsten resources are now decreasing. Accordingly, the development of substitute materials is of great technical significance.

There are hardly present tool materials having properties intermediate between properties of high speed steel and cemented carbide, and development of tool materials having such specific properties has been highly demanded in the art.

It is a primary object of this invention to solve the foregoing problems. More specifically, the primary object of this invention is to provide a novel hard alloy having a hardness higher than that of high speed steel and such hardness and strength as to make it comparable to cemented carbides. Moreover, the alloy of the present invention has a low specific weight and can be manufactured at a low cost without the fear of shortage of the raw materials involved. The present invention also provides a method of making such hard alloy.

SUMMARY OF THE INVENTION

This invention provides a tool or hard material which can be used effectively as a substitute for high speed steel, cemented carbide or tool steel.

More specifically, this invention relates to a novel sintered alloy of a boride containing iron consisting essentially of a hard phase composed of iron boride or a multiple boride containing iron and a metal or alloy phase composed mainly of at least one metal selected from Cu, Co. Ni, Fe, metals of the Groups IV-a, V-a and VI-a of the Periodic Table and alloys of these metals, and to a method of making such sintered alloy.

BRIEF DESCRIPTION OF THE DRAWING

The drawing is a graph illustrating the relationship between the chromium content and the weight increase by oxidation in an iron-8% boron-chromium alloy.

DETAILED DESCRIPTION OF THE INVENTION

The hard alloy of this invention has a structure consisting essentially of a hard phase composed of a boride or multiple boride containing iron and a metal or alloy phase. This hard phase is composed of iron boride or a multiple boride containing iron in which a part of iron boride is replaced by one or more of non-ferrous borides and non-ferrous multiple borides.

Boron is a basic component of the sintered hard alloy of this invention which forms a hard phase as the boride and imparts the hardness to the alloy. The boron content in the sintered alloy of this invention is 3 to 20% by weight, preferably 5 to 5% by weight. When the boron content is lower than 3% by weight, the hardness of the sintered alloy does not reach a desired high level. Accordingly, the lower limit of the boron content is 3% by weight, preferably 5% by weight. In contrast, if the boron content is too high, the density of the sintered alloy is low, resulting in reduction of the transverse rupture strength, and it is difficult to obtain a sufficient toughness. Accordingly, in this invention, it is specified that the upper limit of the boron content is 20% by weight, preferably 15% by weight.

The content of iron in an alloy powder containing a hard phase-forming boride is 20 to 96% by weight, preferably 30 to 95% by weight, based on the entire sintered alloy. Iron, is a basic component of the sintered alloy of this invention, which is excellent and advantageous in the following points.

A sintered body of an iron-containing boride has high hardness and high toughness. If suitable amounts of such elements as Cr, Mo, Ti, Zr, V, Ni and Co are added, high corrosion resistance, high heat resistance and high oxidation resistance, comparable to that of stainless steel or heat resistant steel can be obtained, and the hardness is further enhanced and high hardness and high strength can be maintained, even at high temperatures. Powder which comprises a boride containing iron as the main metal component can easily be prepared industrially, iron resources are rich, and the cost of iron is very cheap.

During the sintering operation, a part of the B or Fe migrates into the metal phase. Accordingly, the content of iron in the above-mentioned starting powder should be regarded as the iron content in the entire sintered alloy.

The iron-containing multiple forming the hard phase includes, in addition to boron and iron, one or more of boride-forming elements such as Cr, Mo, W, V, Nb, Ta, Ti, Zr, Hf, Mn, Co, Ni and Si. Their borides or multiple borides with iron are effective for maintaining the hardness of the alloy at a high level, and Al, Si, C, N and the like are contained in small amounts as impurities in the raw material. Among the multiple boride-forming elements, Cr, Mo, Ti, Zr and the like have effects of not only heightening the melting point and the hardness of the boride but also providing a high corrosion resistance at room temperature, as well as high oxidation resistance at high temperatures. Especially, the incorporation of Cr is necessary to impart sufficient corrosion resistance and oxidation resistance to the resulting sintered alloy. Ni and Co are effective for improving the corrosion resistance and oxidation resistance. Further, the presence of Cr, Mo, W, V, Nb, Ta, Ti, Zr and Hf increases the hardness at room temperature and maintains a high hardness and strength at high temperatures. Accordingly, when it is intended to use the sintered alloy for production of cutting tools for metals and metal molds for hot working of metals, namely to apply the sintered alloy to uses where high temperature hardness and high temperature strength are required, it is necessary to incorporate suitable amounts of these metal elements, for example, Mo, Cr and W. The content of each of these elements is selected within a range of from 1 to 50% by weight, based on the sintered alloy.

In the sintered alloy of this invention, the metal phase is composed of at least one member selected from Cu, Ni, Co, Fe, Cr, Mo, W, Ti, Zr, V, Nb, Ta, Hf, alloys of these metals, and alloys composed mainly of these metals.

This metal phase seems to act as a binder. Among these metal phase-constituting metals and metal alloys, Cu or a Cu alloy has a relatively low melting point and hence it hardly forms a boride of Cu. It is construed that Cu or a Cu alloy is molten at the sintering temperature to form a liquid phase which is effective for increasing the density of the resulting sintered alloy. The Cu content is generally selected within a range of from 2 to 30% by weight. Metal phase-constitutuing elements other than Cu, Co, Fe and Ni have generally a melting point higher than that of iron boride. However, it is construed that as the sintering temperature is elevated, the elements form a eutectic liquid phase with iron boride and hence, the liquid phase sintering is made possible. Consequently, the resulting sintered body hardly contains pores and it attains a substantially full density of 100% and becomes sufficiently dense and compact. Although the shrinkage of dimension by the liquid phase sintering is as high as 10 to 10%, uniform shrinkage can be accomplished without collapse of the shape by controlling the sintering temperature and the metal contents. For example, even a cylinder having, after sintering, an outer diameter of 80 mm, an inner diameter of 60 mm and a height of 40 mm is uniformly shrunk at sintering without reduction of the circularity and a sintered cylinder having a substantially full density of 100% can be obtained.

Iron-boron alloys, as well as iron, are poor in the corrosion resistance and the rust resistance. For example, an iron-8% boron alloy is readily rusted under the influence of water. In contrast, an iron-8% boron-13% chromium alloy is hardly rusted. Further, iron-boron alloys are inferior in oxidation resistance at high temperatures, and their hardness and strength at high temperatures are not so high. In order to improve the corrosion resistance, rust resistance and oxidation resistance, it is necessary to incorporate Cr, Mo, Ti, Zr and the like into the boride hard phase or the metal phase or both of them. Especially, chromium is a basic element effective for improving these properties, and it is incorporated in an amount of 5 to 50% by weight, based on the sintered alloy.

The relation between the chromium content and the weight increase by oxidation observed when an iron-8% boron-chromium alloy is heated at 700° C in air for 1 hour is shown in the accompanying drawing. As is seen from the drawing, with the increase of the Cr content, the weight increase by oxidation is reduced, and when the chromium content is 17% by weight or higher, the weight increase by oxidation is substantially zero.

Nickel and cobalt have an auxiliary role of improving the corrosion resistance and oxidation resistance. The content of each of these metals is selected within a range of from 1 to 50% by weight based on the sintered alloy.

Such elements as Cr, Mo, W, V, Nb, Ta, Ti, Zr and Hf are effective for increasing the hardness at room temperature and improving the hardness and strength at high temperature. Therefore, when it is intended to apply the resulting sintered body to uses where high temperatures hardness and strength are required, for example, for the production of cutting tools for metals and metal molds for high temperature working of metals, it is necessary to incorporate these metal elements into the hard phase or the metal phase or both of them. The content of each of these metal elements is selected within a range of from 1 to 50% by weight, based on the sintered alloy.

Alloys of the iron-boron system can be molten and cast, but the flowability of the melt is bad and the castability is very poor. Therefore, blowholes or cavities are easily formed and cracks are readily caused at casting. Further, the cast alloy is poor in strength, and is brittle, and hence, it is impossible to subject it to the hot or cold working. Still further, since the cast alloy has too high a hardness, machining of such cast alloy is very difficult. Therefore, such cast alloy can hardly be put into practical use. In contrast, in this invention, according to the powder metallurgy involved, the liquid phase sintering is performed and, as a result, it is possible to obtain a sintered alloy of the iron-boron system having a hard phase and a metal phase which is characterized in that it hardly contains pores and has such a high density as approximating substantially the full density of 100% and a necessary and sufficient strength. Therefore, according to this invention, it is possible to obtain an article of a sintered aloy of the iron-boron system having a final shape of accurate dimensions without performing the machining operation, and the product of this invention has a high practical utility. In case the shape of the intended article is complex and machining is necessary, machining is conducted on a raw material in the green compact state or after presintering at a low temperature, and sintering is then performed to obtain a final product. Accordingly, this invention includes no practical difficulties.

The hard alloy of this invention is prepared by mixing a boride containing iron metal or alloy powder, compact-forming the resulting powder mixture, and sintering the green compact. In this invention, a liquid phase is formed in the metal phase or between the boride and the metal by sintering, and therefore, a dense sintered alloy can be obtained. Accordingly, it is construed that a small amount of boron is contained in the metal phase. If the metal component is incorporated in the starting alloy powder forming the hard phase in an amount excessive over the metal content in the boride constituting the hard phase of the resulting alloy, the starting powder can be directly sintered without particular incorporation of a metal powder forming the metal phase.

From the industrial viewpoint, it is most advantageous to prepare boride powder forming the hard phase of the sintered hard alloy of this invention according to the so-called water-atomizing or gas-atomizing method comprising letting a molten alloy containing iron, ferroboron and desired additive elements fall from small holes and atomizing fine streams of the molten alloy by high pressure water jets or high pressure argon or nitrogen gas projected from nozzles. It is also possible to adopt a method comprising melting such alloy, solidifying the melt to form a boride alloy ingot and pulverizing it mechanically, or a method comprising mixing ferroboron powder with a boride powder of another element. The starting boride powder can also be prepared by a method comprising mixing $CaO \cdot 3B_2O_3 \cdot 5H_2O$ or boric anhydride ($B_2O_3$) with iron or iron oxide and boride-forming elements other than iron, and subjecting the resulting mixture by carbon reduction or thermit reduction using aluminum and magnesium.

Metal powder forming a metal phase is mixed with the so prepared hard alloy of an iron-containing boride and the mixture is formed in a green compact having a desired shape by using a press or cold isotatic press. Then, the green compact is heated in a vacuum or in an atmosphere of a reducing or inert gas, such as hydrogen gas, argon or nitrogen gas, to thereby form a part of a liquid phase locally in the compact, whereby the density of the sintered body can be increased substantially to the full density of 100%. However, in the case of iron-containing multiple boride powders containing a relatively large amount of a high-melting-point boride, such as $TiB_2$ (having a melting point of 2800° to 3000° C), Wb (having a melting point of 2400° to 2800° C), $NbB_2$ (having a melting point of 3000° C), $ZrB_2$ (having a melting point of 2990° to 3090° C) and $MoB_2$ (having a melting point of 2100° C), the temperature for melting should be excessively heightened, if the atomizing method is adopted, which method comprises melting the starting raw material and atomizing the melt by water jets or gases. Therefore, difficulties are involved in the powder preparation to the atomizing method. As means of eliminating such disadvantages, there can be adopted the so-called boronizing process, but the industrial working of this process involves problems. In this condition, we have found that a compact sintered body having a higher hhardness and a higher strength can be obtained by a method comprising adding a powder of a high-melting-point boride-forming metal or alloy to a low-melting-point powder of iron boride or an iron-containing multiple boride that can be prepared relatively easily, compact-forming the mixture and sintering the compact. At the sintering step of this process, a high melting point boride is formed by reaction of the iron boride with a high melting point boride forming element, and simultaneously a liquid phase is generated. The mixing ratio of both the powders is so selected that a suitable amount of a metallic binding phase is left in the resulting structure.

It is also possible to adopt a method comprising regrinding the so prepared sintered body containing a high melting point boride, adding powder of a metal phase forming metal or alloy to the resulting powder, compact-forming the mixture and sintering the resulting compact to obtain a sintered hard alloy.

The particle size of the starting powder has an influence on the strength of the sintered alloy. More specifically, as the particle size of the powder is large, the density is lowered by sintering and also the strength (transverse rupture strength) is reduced. Accordingly, it is preferred that mixing of a hard phase-forming boride powder with a metal phase-forming metal or alloy powder should be performed sufficiently by using a ball mill or a vibration ball mill and the mixture be ground or pulverized to fine particles. The particle size of the powder is generally reduced below 325 mesh (43 $\mu$m) and it is preferred that the particle size be smaller than 20$\mu$m.

In order to obtain a sufficient transverse rupture strength, it is indispensable that the density of the sintered body should be heightened to such a high level as approximating substantially the full density of 100%. In the sintered body hard alloy of this invention, since it is possible to easily heighten the density substantially to the full density of 100% by the liquid phase sintering as mentioned hereinabove, the strength of the sintered body can be increased sufficiently.

In the sintered hard alloy of this invention, the density is heightened by the liquid phase sintering. In addition, it is possible to obtain a sintered body of a high density according to the hot isostatic press process, the hot press process or the electro-discharge sintering process, alone or in combination with the liquid phase sintering process.

The sintered body prepared according to this invention has generally a Rockwell A scale hardness of 82 to 94 (corresponding to a Vickers hardness of 750 to 2000) and a transverse rupture strength of 50 to 200 $Kg/mm^2$, as measured according to the test method of JIS H 5501 on tips of cemented carbide alloys.

The sintered hard alloy prepared according to this invention can be applied to uses where high speed steels and cemented carbide alloys have heretofore been employed. More specifically, the sintered hard alloy of this invention can be used for production of tools, dies or punches for drawing, ironing or swaging metals which are used at room temperature and at elevated temperatures, metal molds for cold or hot working, cutting tools and heat resistant alloy articles used at high temperatures. Still further, it can be applied to uses where a high rust resistance, a high oxidation resistance, a high hardness and a high strength are required.

Moreover, the sintered hard alloy of this invention can be used for production of composite metal materials by laminating it on other metal substrates or spray-coating it on metal substrates.

This invention will now be described in detail by reference to the following Examples, which Examples by no means limit the scope of this invention.

EXAMPLE 1

A molten alloy formed by melting iron, ferroboron and ferrochromium as raw materials in a high frequency induction furnace was pulverized by water atomizing under a water of 70 $Kg/cm^2$ to prepare a boride alloy powder having a particle size smaller than 80 mesh and containing 7.8% by weight of boron and 11.7% by weight of chromium, the balance being iron and small amounts of impurities.

The so obtained powder was mixed with Cr powder, Ni powder, and W powder at a mixing ratio of 90 : 5 : 3 : 2, and the mixture was wet-milled for 48 hours by means of a ball mill using an ethyl alcohol solution, and then dried in a vacuum. The dried particulate mixture was compact-formed into a metal mold into a size of 5.2 mm × 10.4 mm × 3.2 mm under a molding pressure of 3 $t/cm^2$. (In the subsequent Examples, green compacts had the same size as mentioned above, unless otherwise indicated.) The so-obtained green compact was sintered at 1170° C in a vacuum of $10^{-4}$ mm Hg for 3 hours. (In the subsequent Examples, the vacuum was the same, i.e. $10^{-4}$ mm Hg for 3 hours. (In the subsequent Examples, the vacuum was the same, i.e. $10^{-4}$ mm Hg.)

A compact sintered article having a transverse rupture strength of 130 $Kg/mm^2$ and a Rockwell A scale hardness ($H_RA$) of 85 was obtained.

EXAMPLE 2

The iron base multiple boride of Example 1 was mixed with Cr powder at a mixing weight ratio of 90 : 10, and the mixture was wet-milled for 48 hours by means of a ball mill, dried in a vacuum and compact-formed under a molding pressure of 3 $t/cm^2$. The resulting green compact was sintered in vacuum at 1200° C for 3 hours to obtain a sintered article having a transverse rupture strength of 115 $Kg/mm^2$ and a Rockwell A scale hardness ($H_RA$) of 84.

EXAMPLE 3

The iron base multiple boride of Example 1 was mixed with an iron alloy powder containing 1.3% by weight of Ni, 0.6% by weight of Mo and 1.6% by weight of Cu, the balance being Fe, at a mixing weight ratio of 90:10, and the mixture was wet-milled for 48 hours by means of a ball mill, dried in a vacuum and compact-formed under a molding pressure of 3 t/cm$^2$. The resulting green compact was sintered in a vacuum at 1180° C for 3 hours to obtain a compact sintered article having a transverse rupture strength of 120 Kg/mm$^2$ and a Rockwell A scale hardness ($H_RA$) of 83.

EXAMPLE 4

A molten alloy formed by melting iron, ferroboron and ferrochromium as raw materials by a high frequency induction furnace was pulverized by the water atomizing method to prepare an iron base boride alloy powder having a particle size smaller than 80 mesh and containing 16.6% by weight of boron and 9.5% by weight of chromium, the balance being iron.

The so obtained boride alloy powder was mixed with Mo powder, Cr powder, Ti powder, and Fe powder at a mixing weight ratio of 45 :27 : 12 : 7 : 9, and the mixture was wet-milled for 48 hours by means of a ball mill and dried in a vacuum.

The resulting powder was compact-formed under a pressure of 3 t/cm$^2$, and the green compact was sintered in a vacuum at 1300° C for 2 hours.

A compact sintered article having a transverse rupture strength of 100 Kg/mm$^2$ and a Rockwell A scale hardness ($H_RA$) of 89 was obtained.

EXAMPLE 5

The iron base multiple boride powder of Example 4 was mixed with Ti powder and Fe powder at a mixing weight ratio of 70 : 20 : 10, and the mixture was wet-milled for 48 hours by means of a ball mill and dried in a vacuum.

The resulting powder was compact-formed under a pressure of 3 t/cm$^2$, and the green compact was sintered in a vacuum at 1300° C for 2 hours.

A compact sintered article having a transverse rupture strength of 78 Kg/mm$^2$ and a Rockewell A scale hardness ($H_RA$) of 86 was obtained.

The so-obtained sintered article was identified by X-ray diffraction, and it was found that $Fe_2B$, $TiB_2$, and a small amount of Fe were present.

The presence of FeB was not confirmed.

Accordingly, it was found that, during the sintering step, the iron base multiple boride powder containing a low melting point iron boride, i.e. FeB (having a melting point of 1540° C) reacted with Ti powder to form a high melting point boride, i.e. $TiB_2$ (having a melting point of 2980° C).

EXAMPLE 6

The iron base multiple boride alloy powder of Example 4 was mixed with Mo powder, Cr powder, Zr powder, Fe powder and Ni powder at a mixing weight of 48 : 25 : 10 : 7 : 8 : 2, and the mixture was wet-milled for 48 hours of a ball mill and dried in a vacuum.

The resulting powder was compact-formed under a pressure of 3 t/cm$^2$, and the green compact was sintered in a vacuum at 1350° C for 2 hours.

A sintered article hving a transverse rupture strength of 68 Kg/mm$^2$ and a Rockwell A scale hardness ($H_RA$) of 90 was obtained.

EXAMPLE 7

The iron base multiple boride alloy powder of Example 4, was mixed with Mo powder, Nb powder, Ti powder, Cr powder, and low carbon steel powder at a mixing weight ratio of 43 : 19 : 7 : 7 : 11 : 13, and the mixture was wet-milled for 48 hours by means of a ball mill and dried in a vacuum.

The resulting powder was compact-formed under a pressure of 3 t/m$^2$, and the green compact was sintered at 1250° C in a vacuum for 2 hours.

A compact sintered article having a transverse rupture strength of 83 Kg/mm$^2$ and a Rockwell A scale hardness ($H_RA$) of 89 was obtained.

EXAMPLE 8

The iron base multiple boride alloy powder of Example 4 was mixed with Mo powder, Ti powder, Cr powder, low carbon steel powder and TiC powder at a mixing weight ratio of 45 : 27 : 6 : 12 : 9 : 1, and the mixture was wet-milled for 48 hours by means of a ball mill and dried in a vacuum.

The resulting powder was compact-formed under a pressure of 3 t/cm$^2$, and the green compact was sintered in a vacuum at 1300° C for 2 hours.

A compact sintered article having a transverse rupture strength of 81 Kg/mm$^2$ and a Rockwell A scale hardness ($H_RA$) of 88 was obtained.

EXAMPLE 9

The Fe-16% B-9.5% Cr powder of Example 4 was mixed with Fe-60% Cr powder, Fe-40% Ti powder, and Fe-60% Mo powder at a mixing weight ratio of 40 : 23.4 : 17.5 : 19.1, and the mixture was wet-milled for 48 hours by means of a ball mill and dried in a vacuum.

The resulting powder was compact-formed under a pressure of 3 t/cm$^2$, and the green compact was sintered in a vacuum at 1300° C for 1 hour.

A sintered article having a transverse rupture strength of 95 Kg/mm$^2$ and a Rockwell A scale hardness ($H_RA$) of 87 was obtained.

The density of the sintered article was 7.01 g/cm$^3$.

EXAMPLE 10

Pure iron and ferroboron containing 20% by weight of boron were molted by a high frequency induction furnace so that the melt contained 8% by weight of boron with the balance being iron, and the molted alloy was atomized to obtain an alloy powder having a particle size smaller than 80 mesh. The so-obtained powder was mixed with copper powder at a mixing weight ratio of 90 : 10, and the mixture was wet-milled and ground for 48 hours by means of a ball mill. The resulting powder was compact-formed under pressure of 3 t/cm$^2$, and the green compact was sintered at 1150° C for 1 hour in a dry hydrogen atomsphere.

The density of the so-obtained sintered article was 7.20 g/cc, and it had a transverse rupture strength of 80 Kg/mm$^2$, and a Rockwell A scale hardness ($H_RA$) of 87.

EXAMPLE 11

An iron-8% boron-13% chromium alloy powder was mixed with a copper-10% antimony alloy powder at a mixing weight ratio of 90 : 10, and a sintered article was prepared from this mixture in the same manner as described in Example 1.

The resulting sintered article had a density of 7.22/cc, a transverse rupture strength of 120 Kg/mm$^2$, and a Rockwell A scale hardness ($H_RA$) of 87.

EXAMPLE 12

The same iron-8% boron 13% chromium alloy powder as used in Example 11 was mixed with copper-10% nickel alloy powder at a mixing weight ratio of 90 : 10, and a sintered article was prepared from this mixture in the same manner as described in Example 1.

The resulting sintered article had a density of 7.20 g/cc, a transverse rupture strength of 150 Kg/mm$^2$, and a Rockwell A scale hardness ($H_BA$) of 88.

EXAMPLE 13

A molten alloy prepared by melting electrolytic iron, chromium, ferroboron and ferrozirconium as raw materials in a high frequency induction furnace was atomized to obtain a multiple boride alloy powder having a particle size smaller than 80 mesh and containing 14.9% by weight of boron, 12.9% by weight of chromium and 3.8% by weight of zirconium with the balance being iron. The so-obtained boride alloy powder was mixed with Ni powder at a mixing weight ratio of 90 : 10, and the mixture was wet-milled for 48 hours by means of a ball mill and compact-formed under a molding pressure of 3 t/m$^2$. The resulting green compact was sintered by heating it at 1250° C in a vacuum for 1 hour. The so-obtained sintered article had a density of 6.72 g/cc, a transverse rupture strength of 60 Kg/mm$^2$, and a Rockwell A scale hardness ($H_RA$) of 91.

What is claimed is:

1. A sintered hard alloy of a boride containing iron which has a structure consisting essentially of a hard phase composed of an iron-containing multiple boride which contains chromium or chromium and molybdenum, and a metal or alloy phase composed mainly of chromium, molybdenum or mixtures thereof and wherein the boron content is 5 to 15 weight %, the chromium content is 5 to 50 weight %, the molybdenum, when present, is present in amounts of 1 to 50 weight % and the iron content is 20 to 96 weight %, wherein the weight % of the various ingredients is based upon the weight of the entire sintered alloy composition.

2. A sintered hard alloy according to claim 1, wherein the iron content is present is amounts of 30 to 95 weight %.

3. A sintered hard alloy according to claim 1 wherein molybdenum is present in the composition in amounts of 1–50 weight %.

4. A sintered hard alloy according to claim 1 wherein the alloy additionally contains nickel or cobalt in amounts of 1–50% to improve the corrosion resistance and oxidation resistance of the alloy.

* * * * *